United States Patent [19]

Holzinger

[11] 4,091,985

[45] May 30, 1978

[54] SELF-LOCKING TRAY

[75] Inventor: Jay J. Holzinger, Bethlehem, Pa.

[73] Assignee: Container Corporation of America, Chicago, Ill.

[21] Appl. No.: 850,423

[22] Filed: Nov. 10, 1977

[51] Int. Cl.[2] ..... B65D 5/26
[52] U.S. Cl. ..... 229/35
[58] Field of Search ..... 229/32, 35

[56] References Cited

U.S. PATENT DOCUMENTS

| | | | |
|---|---|---|---|
| 2,138,112 | 11/1938 | Means et al. | 229/35 X |
| 2,155,450 | 4/1939 | Shoemaker | 229/35 X |
| 2,846,930 | 8/1958 | Gross | 229/35 X |
| 3,093,291 | 6/1963 | Brandle | 229/35 |
| 3,203,619 | 8/1965 | Wilson | 229/35 X |

*Primary Examiner*—Davis T. Moorhead
*Attorney, Agent, or Firm*—Carpenter & Ostis

[57] ABSTRACT

A paperboard tray has slots and slit extensions formed in the end wall. A lock tab hinged to an end closure flap foldably attached to a side wall is received through said slot and slit extension to interlock the walls of the tray.

1 Claim, 3 Drawing Figures

SELF-LOCKING TRAY

BACKGROUND OF THE INVENTION

1. Field of the Invention

This invention relates to trays formed from paperboard, or the like, and, more particularly, to paperboard trays which are of the self-locking type.

2. The Prior Art

The insertion of a lock tab into a slot for locking purposes is well known in the art. This locking arrangement, however, has been found to be inadequate in that the slot, through usage or inaccurate cutting, may become too large to tightly hold the tab thus failing to provide secure interlocking of the walls of the tray. The present invention overcomes the above noted disadvantages and provides a secure self-locking arrangement by inserting a lock tab into a slot having a slit extension for tightly holding the tab.

SUMMARY OF THE INVENTION

A wall of a tray has slots and slit extensions through which a lock tab is received. The lock tab is hingedly attached to another wall of the tray which is normal to the wall formed with the slot and slit extension.

DRAWING

Figure 1:
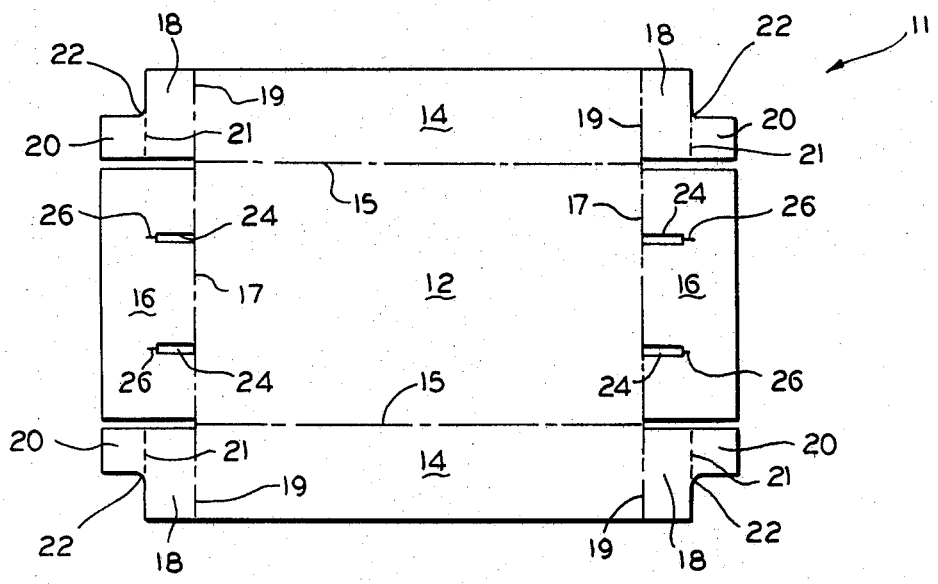
FIG. 1 is a plan view of a blank from which the tray of the present invention is formed.
Figure 2:
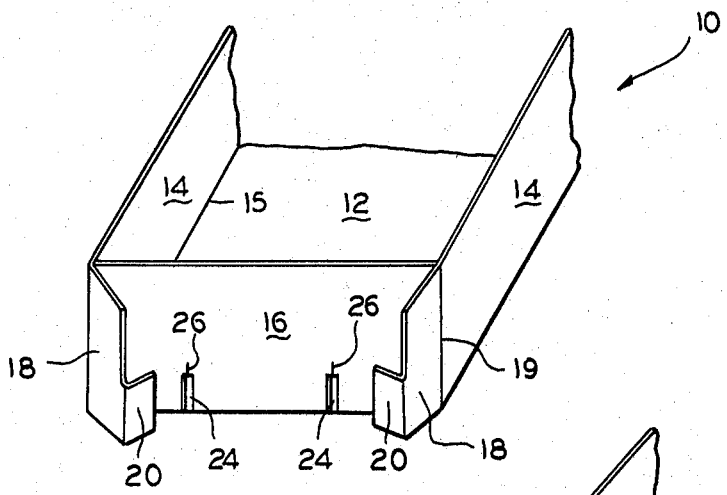
FIG. 2 is a perspective view of a portion of tray being erected.
Figure 3:
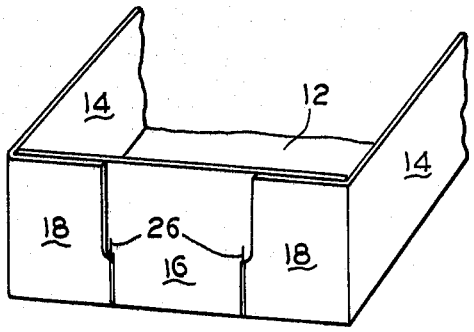
FIG. 3 is a perspective view of a portion of locked tray.

Referring now to the drawing, a tray, generally designated 10, is formed from a cut and scored blank, generally designated 11.

The tray has a bottom wall 12 and a pair of side walls 14 hinged to the side edges of said bottom wall along score lines 15. A pair of end walls 16 are hinged along score line 17 to the other two edges of the bottom wall.

End closure flaps 18 are foldably attached to the end edges of the side walls 14 along fold lines 19. Lock tabs 20 are integrally formed with said closure flaps 18 and are folded approximately normal thereto along a fold line 21 when the tray is being erected. A corner formed between the flap 18 and the tab 20 has a slight curvature 22 the purpose of which will be explained later.

The end walls 16 have slots 24 cut therein. The slots have slit extensions 26 cut into the end walls immediately above the slots and located substantially centrally of the slots.

When the tray is being erected, the lock tabs 20 are received by the respective slots 24 and related slit extensions 26 to lock the end closure flaps 18 to the end walls 16 thereby interlocking the walls of the tray and erecting the tray. The curvature 22 mentioned heretofore permits obstruction free entry of the tab into the slot and its slit extension. The slit extension 26 engages the tab 20 tightly to prevent accidental withdrawal thereof from the end wall 16 and thus collapsing the tray.

I claim:

1. A tray formed from a cut and scored blank of paperboard, or the like, comprising:

(a) a bottom wall, a pair of side walls hinged to the side edges of said bottom wall, and a pair of end walls hinged to the end edges of said bottom wall;

(b) an end closure flap hingedly projecting from an end edge of each of said side walls and being folded to overlap a portion of said end wall;

(c) said flap having a lock tab integrally formed therewith and folded approximately normal thereto;

(d) a slot formed in each of said end walls and having a slit extension cut in said wall;

(e) said lock tab being received in said slot and said slit extension for locking engagement with said end wall thereby securing said walls of said tray together, wherein said slit extension is cut in said end wall immediately above said slot and centrally thereof.

* * * * *